United States Patent [19]

LaPiana

[11] Patent Number: 4,802,280

[45] Date of Patent: Feb. 7, 1989

[54] DEVICE FOR REMOVING PUTTY FROM A WINDOW

[76] Inventor: John LaPiana, 89 Pennsylvania Ave., Somerville, Mass. 02145

[21] Appl. No.: 151,158

[22] Filed: Feb. 11, 1988

[51] Int. Cl.[4] ..... B26B 27/00

[52] U.S. Cl. ..... 30/293; 30/169

[58] Field of Search ..... 30/169, 172, 286, 287, 30/291, 293, 294; 7/105

[56] References Cited

U.S. PATENT DOCUMENTS 1,390,126 9/1921 Halaska ..... 30/169 X 2,602,995 7/1952 Hurt ..... 30/169 X 3,138,867 6/1964 Harrison ..... 30/287 X

*Primary Examiner*—Frank T. Yost

*Assistant Examiner*—Michael D. Folkerts

*Attorney, Agent, or Firm*—Robert T. Gammons

[57] ABSTRACT

A device for removing putty from a window frame in the form of an L-shaped blade and a support to which the blade is adjustably attached, the support being provided with a handle and guide by means of which the blade can be moved along the window frame adjacent the groove within which the putty is located to remove the putty from the groove.

1 Claim, 1 Drawing Sheet

DEVICE FOR REMOVING PUTTY FROM A WINDOW

BACKGROUND OF THE INVENTION

Usually when broken window glass is removed from a window frame, a torch is used to soften the putty and a putty knife or the like is then used to scrape the softened putty from the recess. The aforesaid procedure is slow, tedious and often burns the window frame. It is the purpose of this invention to provide an implement with which old and/or broken putty can be quickly and easily removed.

SUMMARY OF THE INVENTION

As herein illustrated, the tool for removing old or broken putty from a window frame comprises an elongate, rectangular guide defining a guiding surface for engagement with a face of the window frame adjacent the glass receiving recess, a cutter mounted to the guide and extending therefrom into the recess, said guide being movable along the frame while held engaged therewith to strip the putty from the recess and a handle to which the guide is fixed for effecting movement of the guide relative to the frame. The cutter is adjustably mounted to the guide for adjustment relative to the guide for recesses of different depth and comprises an L-shaped blade, one leg of which is mounted to the guide and the other of which extends at right angles thereto. The handle is U-shaped and the guide is secured at its opposite ends between the legs of the U-shaped handle.

The invention will now be described with reference to the accompanying drawings, wherein.

Figure 1:
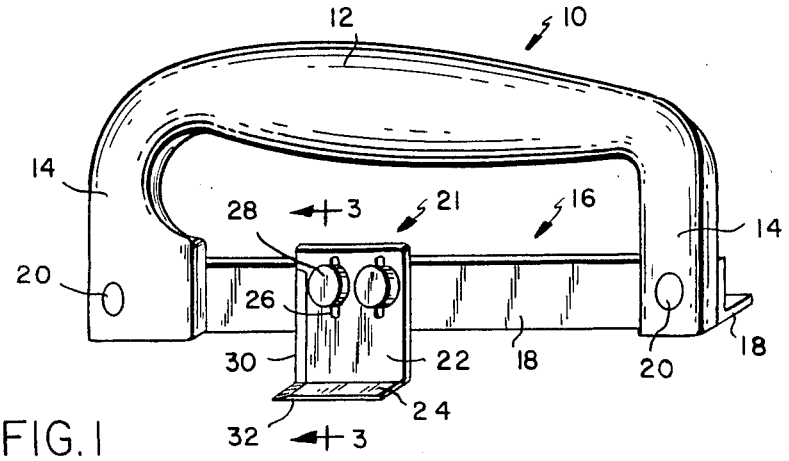
FIG. 1 is a side elevation of the device as seen from one side.
Figure 2:
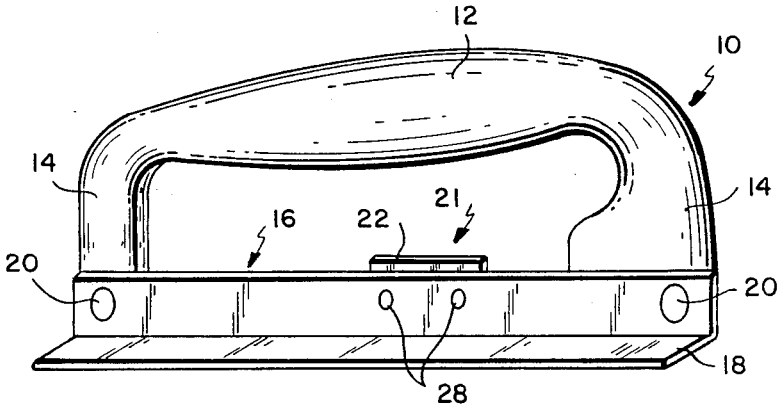
FIG. 2 is a side elevation of the device as seen from the other side.

Referring to the drawings, the implement comprises a U-shaped handle 10 defining an elongate hand-gripping portion 12, at the opposite ends of which are transversely-spaced legs 14—14. Between the legs 14—14, there is mounted an elongate guide 16 of L-shaped cross section having a rectilinear edge face 18. The opposite ends of the guide 16 are connected to helegs 14—14 by means of fasteners 20—20. In cross section, as shown in FIG. 2, the edge face 18 is uniformly flat.

Figure 4:
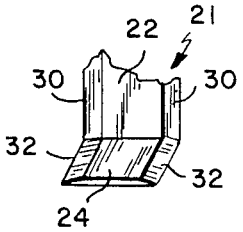
FIG. 4 is a an elevation of a cutting blade provided with cutting edges at each side.

An L-shaped blade 21 comprising a vertical leg 22 and a horizontal leg 24 is adjustably mounted to the guide 16 for vertical movement heightwise with respect to the guide 16 by means of spaced, parallel slots 26—26 and screws 28—28 which enable adjusting the height of the blade 21 relative to the edge face 18 of the guide 16. As illustrated, the leg 22 is perpendicular with respect to the edge face 18 and the leg 24 is parallel to the 18 and extending at right angles thereto. Along one or both edges of the blade 21 there are cutting edges 30 and 32, FIG. 4.

Figure 3:
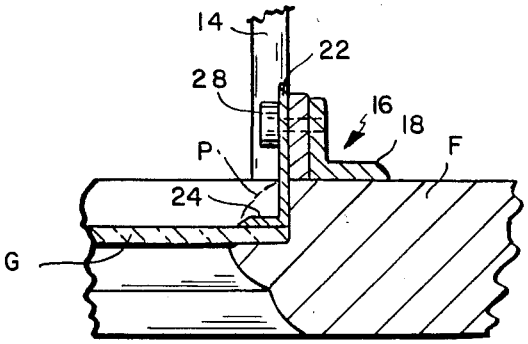
FIG. 3 is a fragmentary transverse section of the device as applied to a window frame.

In use, as shown in FIG. 3, the device is placed against a side of the window frame F adjacent the groove G within which the glass is normally secured by means of putty P and moved longitudinally while supported in parallel relation to the groove by the edge face 18. The cutting edges 30 and 32 can thus be caused to cut the putty from the groove. Since the grooves in window frames may be of different depth for different size windows, the blade 21, as related above, can be adjusted to bring the edge 24 to the bottom of the groove.

The device may be formed of metal, wood or plastic. The guide 16 is comprised of a wear-resistant metal, desirably aluminum, and is adjustable in order to insure so positioning the blade as to remove the putty without cutting into the window frame itself. The actual length of the guide is approximately 5 ½ inches and the overall height is approximately 3 inches. The handle may be comprised of wood, plastic or metal. The L-shaped guide is approximately ½ times ½ inches.

Desirably, the blade is made of a high carbon steel so as to insure permanence of the cutting edge.

It should be understood that the present disclosure is for the purpose of illustration only and includes all modifications or improvements which fall within the scope of the appended claims.

What is claimed is:

1. A tool for removing putty from the recess around a window frame within which the edge of the glass is mounted, comprising an elongate, U-shaped handle embodying a handle grip portion and longitudinally-spaced attaching legs disposed at right angles to the handle, an elongate guide of L-shaped cross section defining an attaching flange for attachment to the legs and a guide flange for engagement with the window frame adjacent the glass-receiving opening, bolts attaching the attaching flange to the legs at one side of the legs in a position such that the guide flange extends at right angles to the legs in a direction away from the legs and a detachable, adjustably-mounted, L-shaped cutting blade mounted to the attaching flange at the side thereof opposite the guide flange, said L-shaped cutting blade embodying right-angularly disposed legs comprising a first leg and a second leg, transversely-spaced, parallel cutting edges at the opposite edges of the legs, means comprising second bolts detachably mounting the first leg of the cutting blade to the attaching flange in a position such that the second leg extends downwardly from the guide flange and in a direction away from the attaching flange at right angles thereto and wherein said first leg contains spaced, parallel, elongate slots perpendicular to the second leg for receiving the attaching bolts and wherein said second flange contains threaded openings for receiving the second bolts by means of which the L-shaped cutting blade is attached to the attaching flange for adjustment relative to the guide flange.

* * * * *